US005952979A

United States Patent [19]

Choi

[11] Patent Number: 5,952,979

[45] Date of Patent: Sep. 14, 1999

[54] APPARATUS FOR PROVIDING TILTING AND ROTATIONAL MOVEMENTS IN AN ANTENNA

[75] Inventor: Yong-Hwan Choi, Seoul, Rep. of Korea

[73] Assignee: Daewoo Electronics Co., Ltd., Rep. of Korea

[21] Appl. No.: 08/747,060

[22] Filed: Nov. 12, 1996

[30] Foreign Application Priority Data

Nov. 13, 1995 [KR] Rep. of Korea ..... 95-40952

[51] Int. Cl.[6] ..... H01Q 3/08; H01Q 1/12

[52] U.S. Cl. ..... 343/766; 343/882

[58] Field of Search ..... 343/768, 765, 343/882; H01Q 3/06

[56] References Cited

U.S. PATENT DOCUMENTS

| | | | |
|---|---|---|---|
| 3,604,009 | 9/1971 | Behnke | 343/766 |
| 4,626,864 | 12/1986 | Micklethwaite | 343/766 |
| 5,077,560 | 12/1991 | Horton et al. | 342/359 |
| 5,453,753 | 9/1995 | Cosenza et al. | 343/882 |

FOREIGN PATENT DOCUMENTS

| | | |
|---|---|---|
| 0194943 | 9/1986 | European Pat. Off. . |
| 0235561 | 9/1987 | European Pat. Off. . |
| 0268125 | 5/1988 | European Pat. Off. . |
| 2216340 | 10/1989 | United Kingdom . |

*Primary Examiner*—Michael C. Wimer
*Attorney, Agent, or Firm*—AndersonKill & Olick

[57] ABSTRACT

An apparatus for positioning a parabolic antenna includes a support member for supporting the parabolic antenna, a housing having a pair of frames assembled together for accommodating the support member, a first device for providing tilting movement in the parabolic antenna, and a second device for providing rotational movement in the parabolic antenna in sidewise directions, thereby providing tilting movements in the parabolic antenna and rotational movements therein in sidewise directions.

12 Claims, 4 Drawing Sheets

APPARATUS FOR PROVIDING TILTING AND ROTATIONAL MOVEMENTS IN AN ANTENNA

FIELD OF THE INVENTION

The present invention relates to a parabolic antenna; and more particularly, to an apparatus capable of selectively positioning the parabolic antenna to optimize its receptibility.

BACKGROUND OF THE INVENTION

There is shown in FIG. 1 a schematic view of a conventional parabolic antenna system 10 including a parabolic antenna 20 and a mounting post 30. The parabolic antenna 20 has a paraboloidal reflector 21 for reflecting signals from satellites, a mounting pad 22 disposed at back center of the reflector 21, an arm 23 whose one end is fixed to the mounting pad 22, and a feed horn 24 for receiving signals reflected from the reflector 21. The feed horn 24 is mounted at the other end of the arm 23 so as to be positioned at a focal point of the reflector 21 which is aimed to a selected satellite. The mounting post 30 is fixed to the mounting pad 22 at its one end to support the reflector 21. Establishment of the parabolic antenna 20 is completed by anchoring the mounting post 30 to a desired place.

In such an antenna system, when the reflector becomes misaligned with the selected satellite, it is difficult to correct the misalignment therebetween, since the antenna is firmly fixed to the mounting post via the mounting pad, which, in turn, is firmly anchored.

SUMMARY OF THE INVENTION

It is, therefore, an object of the present invention to provide an apparatus for providing tilting and rotational movements in a parabolic antenna.

In accordance with one aspect of the present invention, there is provided an apparatus for providing tilting and rotational movements in a parabolic antenna comprising a support member for supporting the parabolic antenna, a housing having a pair of frames assembled together for accommodating the support member, a first device for providing tilting movement in the parabolic antenna, a second device for providing rotational movement in the parabolic antenna in sidewise directions, and means for setting the support member at a predetermined operating position, wherein the setting means has a pair of first pieces and a pair of second pieces, each of the second pieces being provided with a knurled portion, the pair of first pieces being provided at the support member, the pair of the second pieces being provided at the housing in such a way that each of the first pieces comes into contact with the knurled portion in each of the second pieces to provide a frictional force therebetween.

BRIEF DESCRIPTION OF THE DRAWINGS

The above and other objects and features of the present invention will become apparent from the following description of preferred embodiments, when taken in conjunction with the accompanying drawings, wherein.

DETAILED DESCRIPTION OF THE PREFERRED EMBODIMENTS

Figure 1:
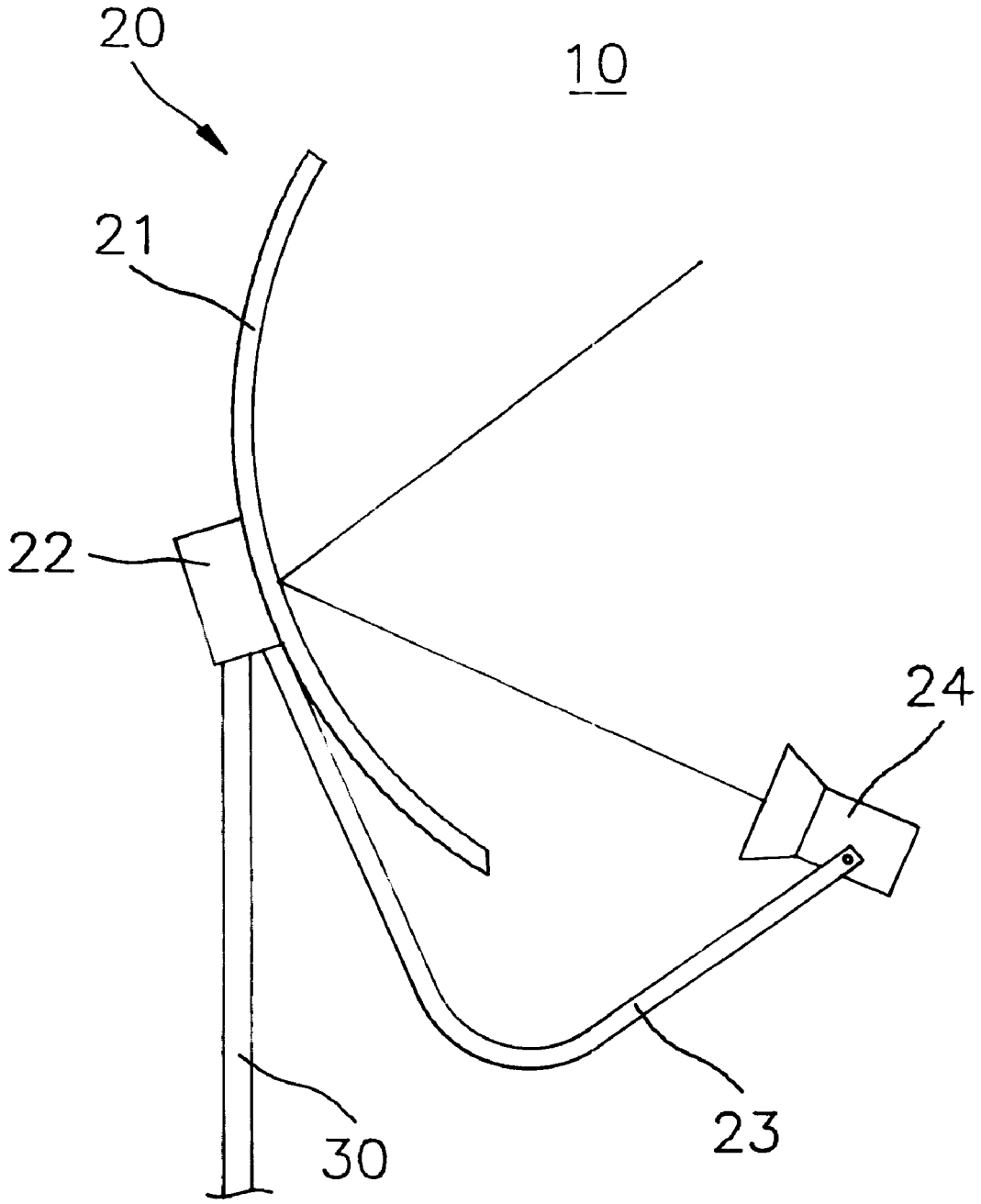
FIG. 1 (PRIOR ART)
FIG. 1 shows a schematic view of a conventional parabolic antenna system.

It should be note that like parts appearing in the drawing are denoted by like reference numerals.

Figure 2:
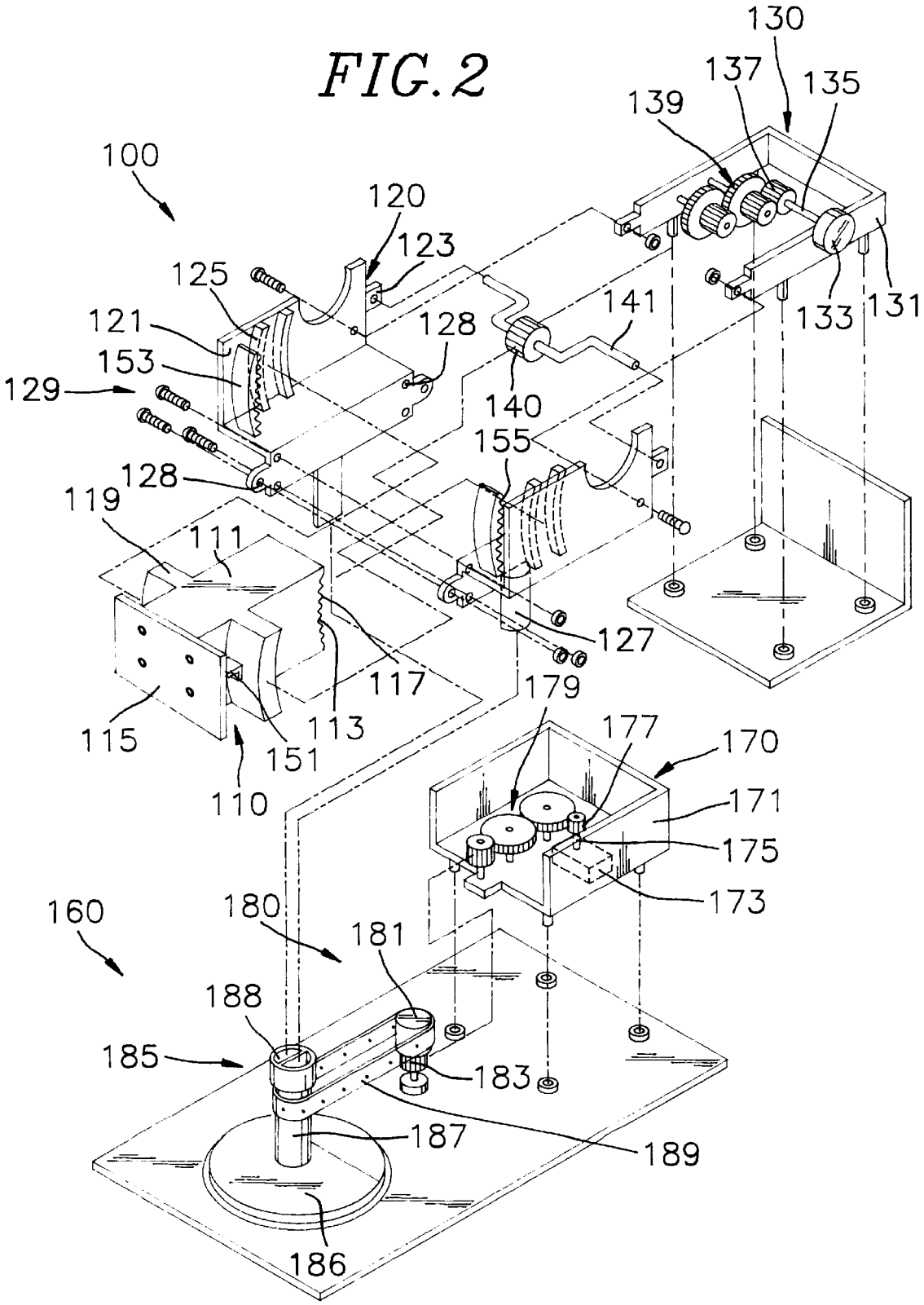
FIG. 2 illustrates an exploded perspective view of a tilting and rotational movement providing apparatus in accordance with the present invention.

There is illustrated in FIG. 2, an exploded perspective view of the inventive apparatus capable of providing tilting movements in the parabolic antenna 20 and rotational movements therein in sidewise directions. Borrowing from flight terminology, the tilting movement belongs to "pitch" and the rotational movement belongs to "yaw". The apparatus comprises a first device 100 for providing tilting movements in the parabolic antenna 20 and a second device 160 for providing rotational movements in the parabolic antenna 20 in sidewise directions.

The first device 100 includes a support member 110 for supporting the parabolic antenna 20, a housing 120 for accommodating the support member 110, a first driving unit 130 for driving the support member 110, an intermediate gear 140 for engaging the first driving unit 130 with the support member 110 and a position setting means for holding the support member 110 at a predetermined operating position.

The support member 110 has a body portion 111 whose one end is provided with a concave surface 113 and the other end is provided with a connection plate 115 for engaging with the parabolic antenna 20. The concave surface 113 is formed with gear teeth 117. The support member 110 also has a pair of substantially vertically extending arcuate shoulder portions 119 which outwardly protrude from the sides of the body portion 111 thereof. It is to be noted that the arcuate shoulder portion 119 is concentric with the concave surface 113.

Figure 3A:
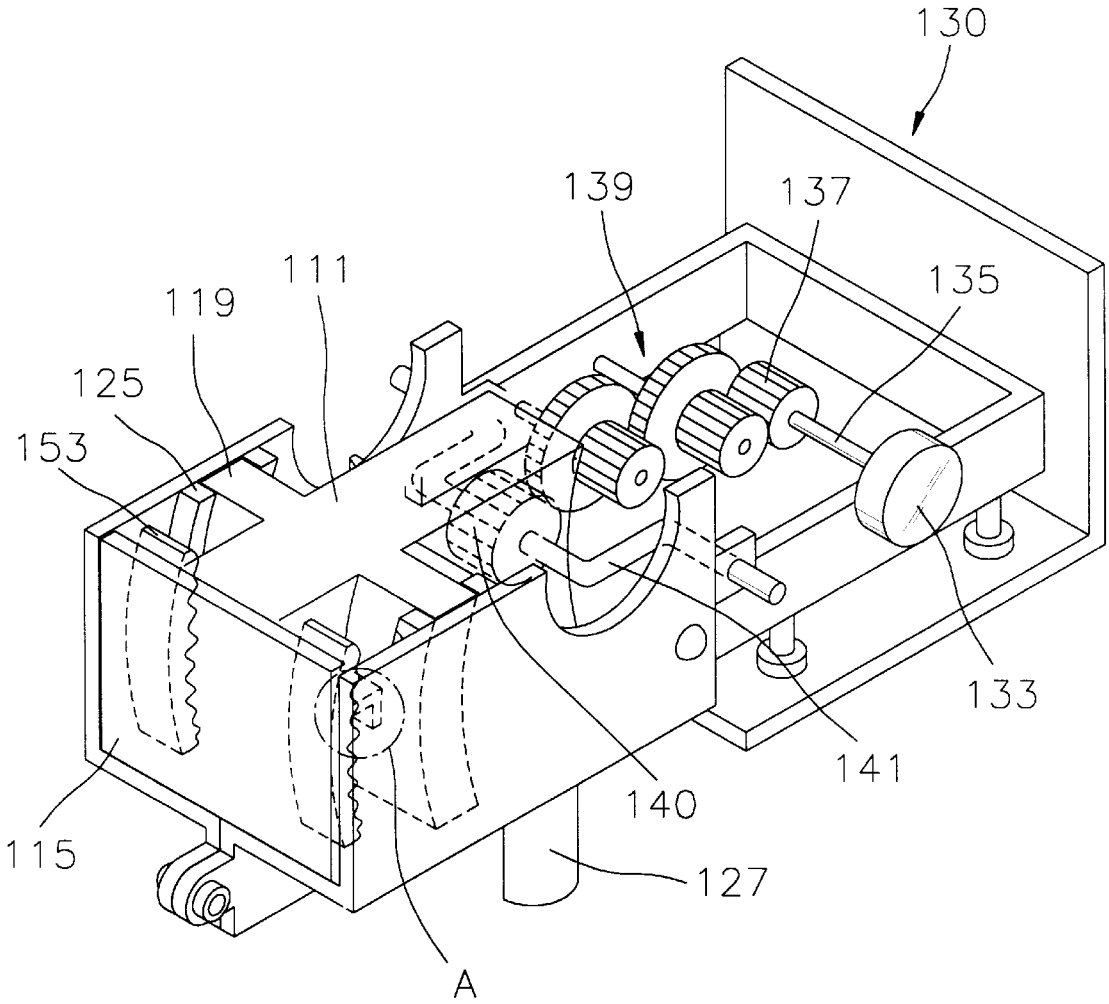
FIG. 3A shows a perspective view of a tilting movement providing a device according to the present invention in an assembled condition thereof.

The housing 120 has a pair of frames 121, each of them being a mirror image of each other. The frame 121 having an apertured pad 123 is provided with a pair of vertically extending arcuate guide ribs 125 for guiding the shoulder portion 119 of the support member 110 and a protrusion 127 downwardly extending therefrom, the protrusion 127 having a semicircle shape. The frame 121 is, further, provided with a plurality of fastener receiving openings 128. The frames 121 are assembled together by engaging a fastening means, e.g., bolt and nut assemblies 129, in and through the fastener receiving openings 128 (see FIG. 3A).

Figure 3B:
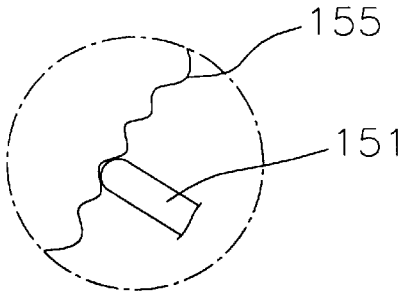
FIG. 3B shows an expanded view of area "A" in FIG. 3.

The position setting means has a pair of first pieces 151 and a pair of second pieces 153, each of the second pieces 153 being formed with a knurled portion 155. The pair of first pieces 151 are suitably provided at the shoulder portions 119 of the support member 110 in such a way that each of the shoulder portions 119 is allowed to be guided by each of the pair of the guide ribs 125 of the frames 121, and the pair of the second pieces 153 are provided at the housing 120 in such a way that one end of each of the first pieces 151 is allowed to come into contact with the knurled portion 155 in each of the second pieces 153. To be more specific, each of the first pieces 155 laterally, rearwardly extends from the shoulder portion 119 of the support member 110 in such a way that its free end is in contact with the knurled portion 155, providing a frictional force therebetween, as shown in FIG. 3B, and each of the second pieces 153 is of arc shape concentric with the shoulder portion 119 of the support member 110. This frictional force is relatively smaller than a driving force exerted by the driving unit 130 which will be described later.

The intermediate gear 140 is rotatably fitted around a support shaft 141 whose ends are fixed to the housing 120 through the apertured pads 123.

The first driving unit 130 has a gear box 131 releasably screw-fastened or otherwise mounted on the housing 120. The gear box 131 has a motor 133 with a shaft 135, a drive gear 137 mounted on the motor shaft 135 and a set of transmission gears 139 meshed with the drive gear 137. The motor 133 is under control of a switching device or means (not shown) which can be intermittently operated to energize and cause the motor to operate or rotate in a clockwise or a counterclockwise directions. The set of transmission gears 139 is, further, meshed with the intermediate gear 140. As clearly shown in FIGS. 3A and 3B, this arrangement allows the engagement of the first driving unit 130 with the parabolic antenna 20.

Figure 4:
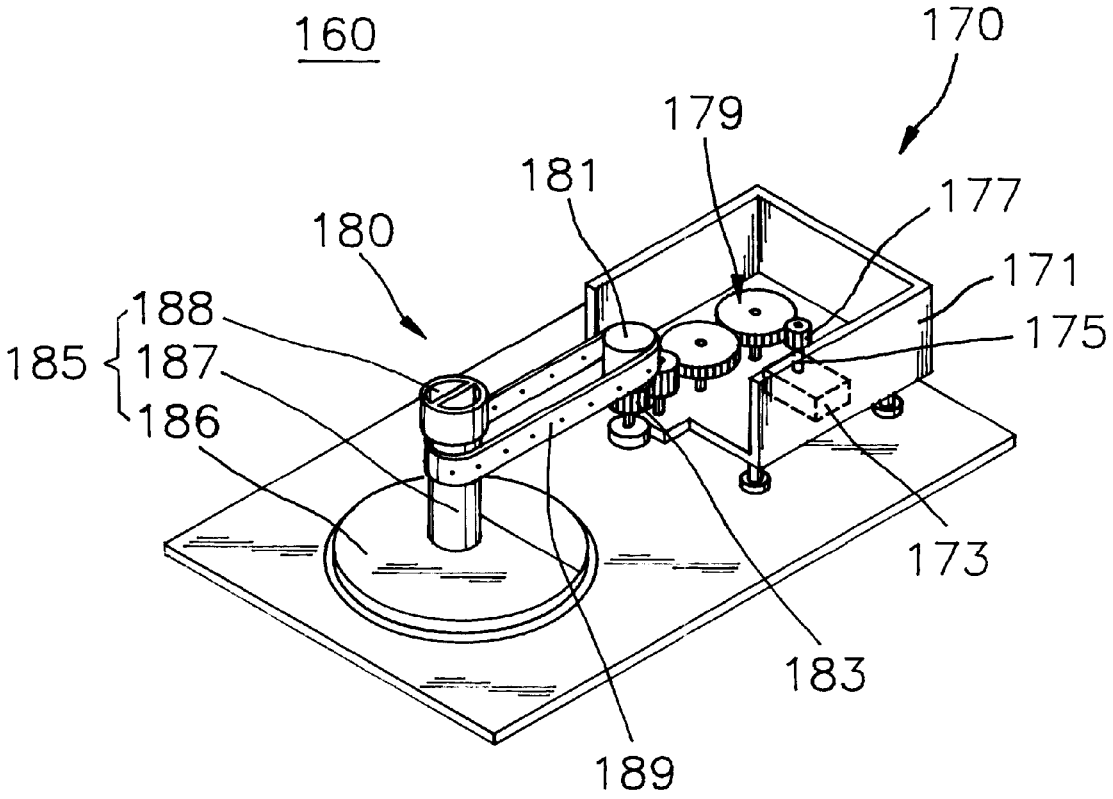
FIG. 4 depicts an assembled perspective view of a rotational movement providing device in accordance with the present invention.

With reference to FIGS. 2 and 4, the second device 160 includes a second driving unit 170 and a power conveying unit 180 for conveying a power from the second driving unit 170 to the housing 120. Similar to the first driving unit 130, the second driving unit 170 has a gear box 171 having a motor 173 with a shaft 175, a drive gear 177 mounted on the motor shaft 175 and a set of transmission gears 179 meshed with the drive gear 177. The power conveying unit 180 has an interlocking member 181, a rotating member 185 and a belt 189. The interlocking member 181 is provided with a gear portion 183 for engaging with the set of the transmission gears 179 of the second driving unit 170 and a rotating member 185 has a rotating plate 186 and a shaft 187 fixed to the central part of the rotating plate 186. The belt 189 couples the interlocking member 181 and the rotating plate shaft 187 for rotational energy transmission of the interlocking member 181. The rotating plate shaft 187 is, at its top part, provided with a pair of blind holes 188 for receiving the protrusions 127 of the housing 120. This structure allows engagement of the second driving unit 170 and the housing 120.

The operating principles of the apparatus in accordance with the present invention will now be described in detail.

When the user drives the motor 133 of the first drive unit 130, its driving force is transmitted into the gear teeth 117 of the support member 110 via the drive gear 137, the set of transmission gears 139 and the intermediate gear 140, which, in turn, moves the supporting member 110. In this case, since the driving force exerted by the motor 133 is relatively larger than the frictional force between the first and the second pieces 151, 153 of the position setting means, as aforementioned, it is possible for the motor 133 to provide the tilting movement in the parabolic antenna 20. Thereafter, when the user stops the operation of the motor 133 after moving the parabolic antenna 20 into a desired position, the support member 110 is set at the foregoing position due to the frictional force exerted between the first and the second pieces 151, 153 of the position setting means.

When the user operates the motor 173 of the second drive unit 170, its driving force is transmitted into the rotating plate shaft 187 via the drive gear 177, the set of transmission gears 179, the interlocking member 181, the belt 189 and the rotating plate 186, which, in turn, moves the housing 120, thereby rotating the parabolic antenna 20 in sidewise directions.

While the present invention has been described with respect to certain preferred embodiments only, other modifications and variations may be made without departing from the scope of the present invention as set forth in the following claims.

What is claimed is:

1. An apparatus for moving an article for receiving or sending a radio wave, comprising:

a support member having a body portion having one end thereof provided with a concave surface formed with gear teeth another end provided with a plate for engaging with the article, for supporting the article;

a housing having a pair of frames assembled together for accommodating the support member, the frames being a mirror image configuration of each other and having a pair of protrusions, each of the protrusions extending downwardly from each frame;

means for providing tilting movement in the article;

means for providing rotational movement in the article in sidewise directions; and means for setting the support member at a predetermined operating position, wherein the rotational movement providing means includes a driving unit having a motor with a shaft, a drive gear mounted on the motor shaft and a set of transmission gears meshed with the drive gear and a power conveying unit having an interlocking member with a gear portion for engaging with the set of transmission gears, a rotating member for rotating and supporting the housing and a rotational energy conveying element for coupling the interlocking member and the rotating member, the rotating member has a rotating plate and a shaft fixed to a central part of the rotating plate, the shaft of the rotating plate being, on its top part, provided with a pair of blind holes for receiving the protrusions of the frames.

2. The apparatus of claim 1, wherein the position setting means has a pair of first pieces and a pair of second pieces, each of the second pieces being provided with a knurled portion, the pair of first pieces being provided at the support member, the pair of the second pieces being provided at the housing in such a way that the first pieces come into contact with the knurled portion of the second pieces to provide a frictional force therebetween.

3. The apparatus of claim 1, wherein the support member further has a pair of vertically extending arcuate shoulder portions which protrude outwardly from the sides of the body portion.

4. The apparatus of claim 3, wherein each of the frames is provided with a pair of vertically extending arcuate guide ribs for guiding a shoulder portion of the support member.

5. The apparatus of claim 1, wherein the tilting movement providing means includes a motor with a shaft, a drive gear mounted on the motor shaft, a set of transmission gears meshed with the drive gear, an intermediate gear engaged with the set of transmission gears and with the gear teeth of the concave surface of the support member.

6. The apparatus of claim 1, wherein the rotational energy conveying element is a belt.

7. An apparatus for moving an article for receiving or sending a radio wave, comprising:

a support member having a body portion for engaging with the article and a pair of vertically extending arcuate shoulder portions which protrude outwardly from the sides of the body portion, for supporting the article;

a housing having a pair of frames assembled together for accommodating the support member, the frames being a mirror image configuration of each other, each of the frames being provided with a vertically extending arcuate guide rib for guiding a shoulder portion of the support member and having a protrusion extending downwardly therefrom;

means for providing tilting movement in the article;

means for providing rotational movement in the article in sidewise directions; and means for setting the support member at a predetermined operating position, wherein the rotational movement providing means includes a driving unit having a motor with a shaft, a drive gear mounted on the motor shaft and a set of transmission gears meshed with the drive gear, and a power conveying unit having an interlocking member with a gear portion for engaging with the set of transmission gears, a rotating member for rotating and supporting the housing and a rotational energy conveying element for coupling the interlocking member and the rotating member, the rotating member having a rotating plate and a shaft fixed to a central part of the rotating plate, the shaft of the rotating plate being, on its top part, provided with a pair of blind holes for receiving the protrusions of the frames.

8. The apparatus of claim 7, wherein the position setting means has a pair of first pieces and a pair of second pieces, each of the second pieces being provided with a knurled portion, the pair of first pieces being provided at the support member, the pair of the second pieces being provided at the housing in such a way that the first pieces come into contact with the knurled portion of the second pieces to provide a frictional force therebetween.

9. The apparatus of claim 7, wherein the body portion of the support member is provided at one end thereof with a concave surface and is provided at another end thereof with a plate for engaging the article.

10. The apparatus of claim 9, wherein the concave surface is formed with gear teeth.

11. The apparatus of claim 10, wherein the tilting movement providing means includes a motor with a shaft, a drive gear mounted on the motor shaft, a set of transmission gears meshed with the drive gear, an intermediate gear engaged with the set of transmission gears and with the gear teeth of the concave surface of the support member.

12. The apparatus of claim 7, wherein the rotational energy conveying element is a belt.

* * * * *